United States Patent [19]

Havens

[11] 4,257,212

[45] Mar. 24, 1981

[54] WRAPPING APPARATUS AND METHOD

[76] Inventor: Jeffrey G. Havens, 5008 N. Pennsylvania St., Apt. 16, Indianapolis, Ind. 46205

[21] Appl. No.: 41,684

[22] Filed: May 23, 1979

[51] Int. Cl.[3] ..... B65B 51/10; B65B 67/10

[52] U.S. Cl. ..... 53/463; 53/219; 53/392

[58] Field of Search ..... 53/218, 219, 390, 392, 53/590, 463

[56] References Cited

U.S. PATENT DOCUMENTS

| | | | |
|---|---|---|---|
| 2,635,672 | 4/1953 | Rumsey, Jr. | 53/219 X |
| 2,725,699 | 12/1955 | Rumsey, Jr. | 53/219 |
| 2,842,910 | 7/1958 | Reed | 53/219 X |
| 2,889,672 | 6/1959 | Anderson | 53/390 X |
| 3,176,443 | 4/1965 | Klamp | 53/219 X |
| 3,254,551 | 6/1966 | Uvodich | 53/390 X |
| 3,412,527 | 11/1968 | Aquarius et al. | 53/218 X |
| 3,521,425 | 7/1970 | Palmer | 53/390 X |

FOREIGN PATENT DOCUMENTS

| | | | |
|---|---|---|---|
| 785372 | 10/1957 | United Kingdom | 53/390 |
| 1334993 | 10/1973 | United Kingdom | 53/390 |

*Primary Examiner*—John Sipos

[57] ABSTRACT

An apparatus is provided for supporting rolls of wrapping material and having a table for convenient reception of sheet, card or plate material in a stack to be wrapped. Means are provided to facilitate the handling of the wrapping material, typically a heat sealable plastic film, folding it over the stack to be wrapped, and moving the stack onto a heat sealing table. Simultaneous severing of extra material from the roll is accomplished. Marginal edge sealing by heat or otherwise is also possible.

23 Claims, 16 Drawing Figures

WRAPPING APPARATUS AND METHOD

BACKGROUND OF THE INVENTION

1. Field of the Invention

This invention relates generally to packaging, and more particularly to wrapping of stacks of material in sheet or card or plate form with a heat sealable material such as a plastic film.

2. Description of the Prior Art

Plastic films are widely used for wrapping articles. Various types of plastic are used depending upon the kind of wrapping technique to be employed. Many such plastics are heat sealable, and some are heat shrinkable onto the product being wrapped. Varieties of devices are available for wrapping products with plastic, the nature of the devices depending upon the nature of the product to be wrapped and the material with which it is to be wrapped.

In the present case, the main interest is in wrapping materials in the form of stacks of sheets, cards, or plates. One example is a stack of writing paper. Although prior art wrapping devices include various features such as heat tables, arbors for mounting rolls of plastic film, and heated members for heat severing plastic materials, I believe there remains a need for inexpensive apparatus which can be conveniently used by an unskilled operator to efficiently wrap such materials. The present invention is directed to that need.

SUMMARY OF THE INVENTION

Described briefly, according to a typical embodiment of the present invention, the apparatus comprises a frame having a generally L-shaped appearance when viewed from the side. It includes three tiers of wrapping film supply rolls at one end, and a pivoting support table at the other end. The support table is arranged for reception of wrapping film on its surface, followed by the stack of material to be wrapped. The table is pivotal backward while the stack is tilted backward and downward to place a portion of the film under the stock and against a heat table for heat sealing the package, and at the same time moving downward a film guiding clevis to move the trailing portion of the film against a heated, film-severing rod, to separate the wrapped film from the feed roll. The partially enclosed package can then be lifted, and the overhanging side margins of film folded inwardly and behind the stack to complete the wrapping. The inwardly folded portions can be heat sealed also, by again placing the stack down onto the heat table.

DESCRIPTION OF THE PREFERRED EMBODIMENT

Figure 2:
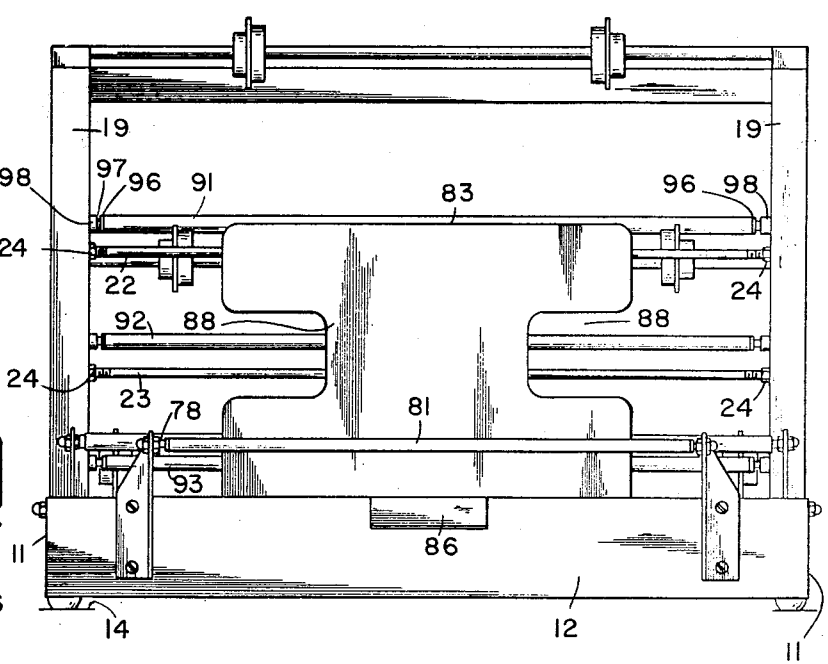
FIG. 2 is a front end view thereof.
Figure 1:
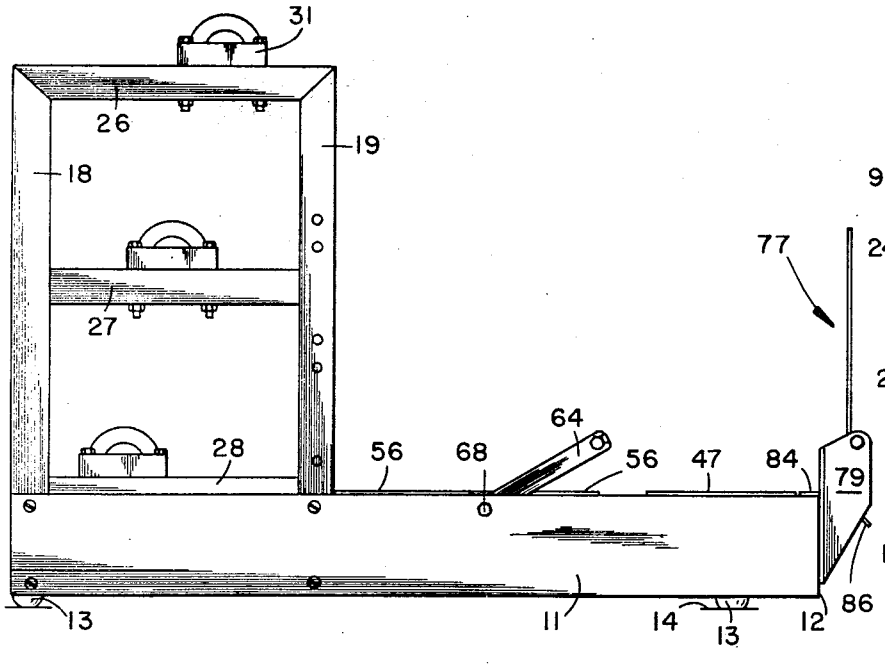
FIG. 1 is an elevational view of a wrapping apparatus according to a typical embodiment of the present invention.

Referring now to the drawings in detail, the frame is typically a weldment having lower side members 11 of L-shaped cross section, and a front cross member 12 of the same cross sectional shape. it is provided with four rubber feet 13 for non-skid contact and support on a tabletop or the like 14. Intermediate and lower rear cross members 16 and 17 (FIG. 59 of rectangular tubular cross section (FIG. 6) provide a sturdy horizontally-spaced relationship between the side members 11 at the rear of the frame.

A supply stand portion of the frame is provided by four columns, two of them 18 being at the rear of the frame, and two of them 19 being horizontally spaced and in front of them. An upper rear cross member 21 is affixed to the upper ends of columns 18. Spacer rods 22 and 23 are received in the columns 19 and retained in place by the nuts 24 threaded onto the ends of these rods. Bearing support members 26, 27 and 28 are affixed to the columns 18 and 19 on opposite sides of the frame. The columns, upper rear cross member 21 and bearing support members are of rectangular tubular cross section as are the cross members 16 and 17.

Figure 6:
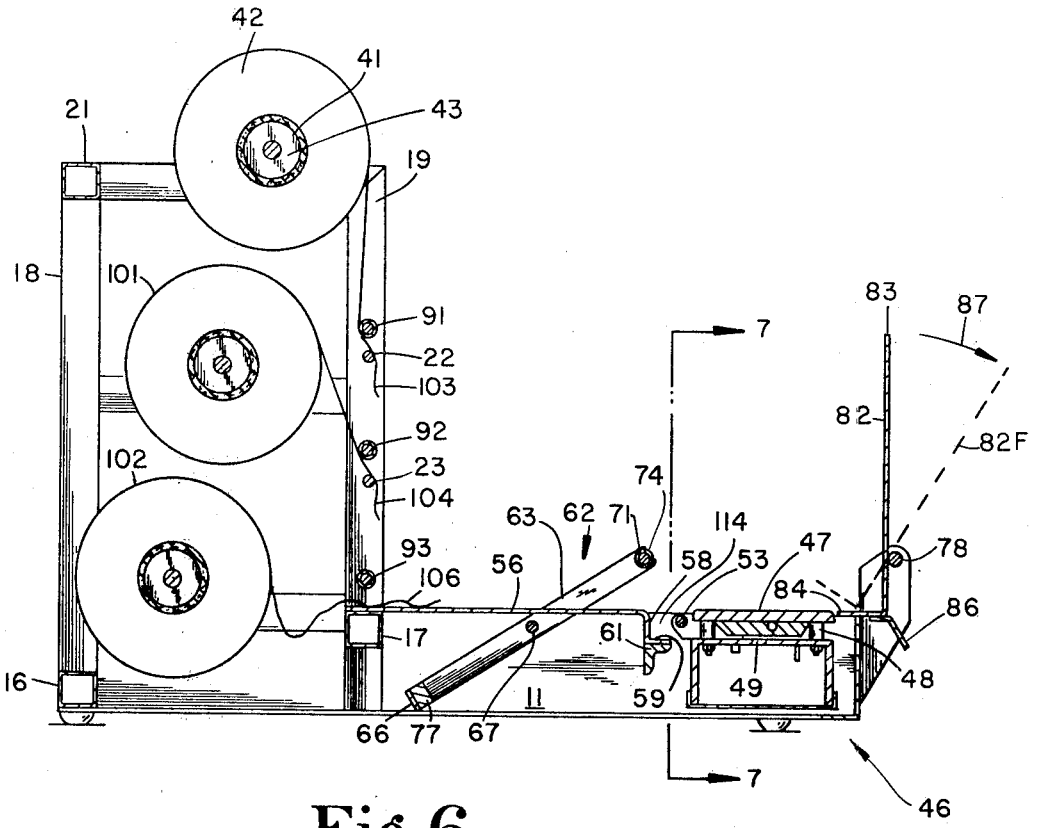
FIG. 6 is a section therethrough taken at line 6—6 in FIG. 5 and viewed in the direction of the arrows.

Each of the three bearing support members on each side of the frame supports a cradle block such as 31 which is bolted thereto and may be made of some appropriate bearing material. "Delrin" is a suitable example, These blocks have a slot in the top as shown at 32 in FIG. 3 to receive a supply roll support shaft 34. Shaft 34 is provided with a pair of hubs 36 axially spaced thereon and secured thereto by set screws 37. Therefore, the upper pair of cradles supports the upper shaft 34. The intermediate pair of cradles supports shaft 38, and the lower pair of cradles supports shaft 39. The spacing of the hubs is such as to accommodate three different widths of plastic film supplied on cores such as core 41 containing the roll of film 42 (FIG. 6). The core 41 is received on the hubs 36 at 43 and retained by the flanges 44. The set screws permit location of the hubs where desired on the shaft 34 to accommodate a film roll of the desired width and, although three different widths are represented by the three different spacings on the three shafts, various other spacings, as well as uniformity of spacings on all three shafts, might be employed, depending upon the particular use to which the apparatus is being put.

Figure 7:
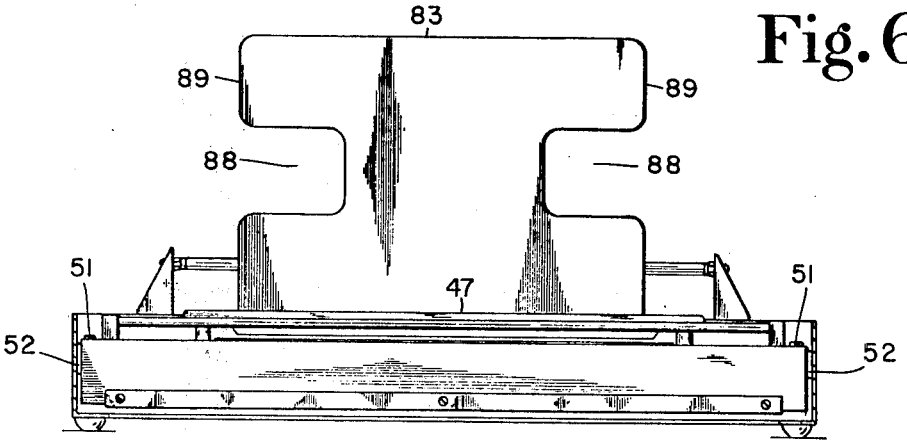
FIG. 7 is a section taken at line 7—7 in FIG. 6 and viewed in the direction of the arrows.

A heat table assembly 46 is mounted in the frame and includes the heated top or platen 47 mounted on four thermally insulated posts 48 to the top of a table support channel cross member 49 secured by screws 51 (FIGS. 7 and 8) to brackets 52 affixed to the side members 11. The heating element is actually included in the platen itself.

Figure 3:
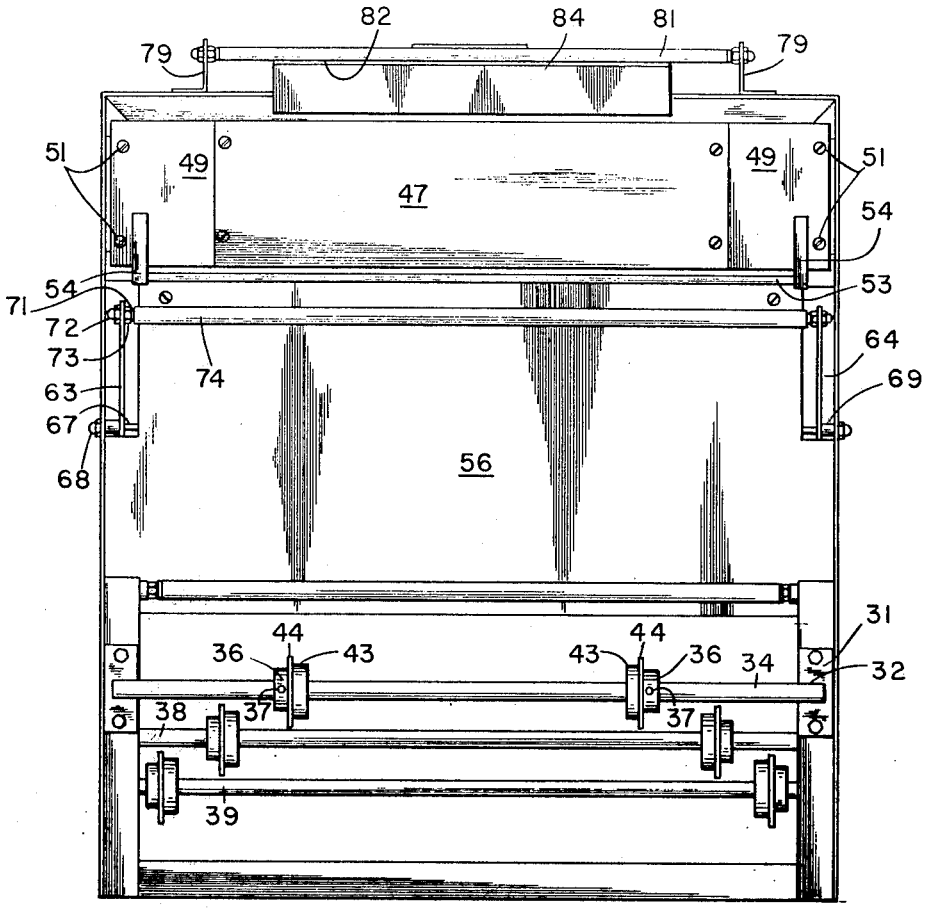
FIG. 3 is a top plan view thereof.
Figure 4:
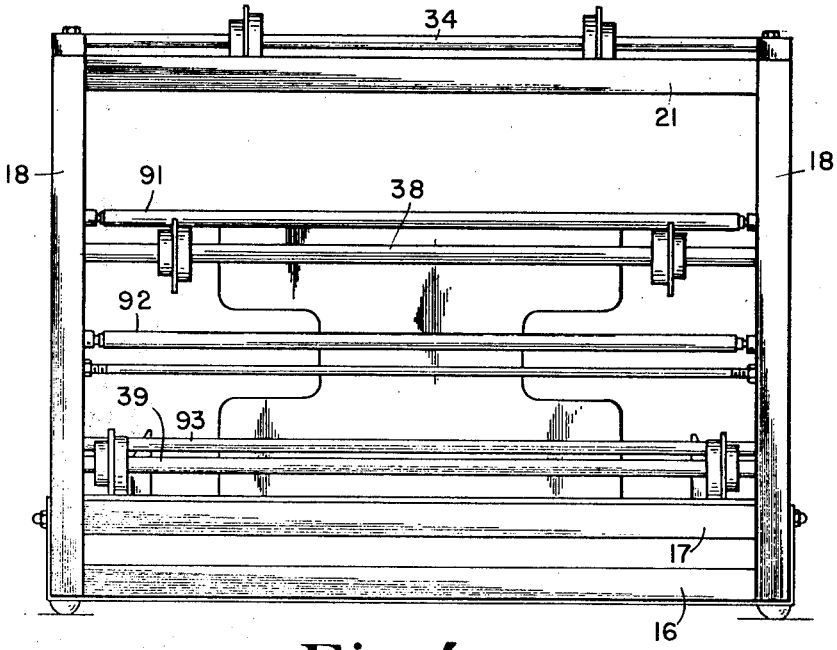
FIG. 4 is a rear end view thereof.

A heat bar or "cut off rod" 53 is mounted to a pair of support arms 54 which are mounted to the top of channel 49. This bar is immediately behind the rear edge of the heat table 47, as is best shown in FIGS. 3 and 6.

A film support table 56 is mounted ahead of the bar and substantially flush with the upper edges of the side members 11, extending from the intermediate cross member 17 forward to a downturned portion at 58 having a rearwardly extending flange 59 received on a support cross member 61 affixed to the side members 11.

A film control clevis is provided according to an important feature of the invention. It includes the parallel side arms 63 and 64 and the bridging cross arm 66. The side arms are pivotally mounted to the clevis pivot shaft 67 which is secured to the two side members 11 by acorn nuts 68 threadedly received on opposite ends of the shaft. Spacers 69 are provided between the arms and the side members. These may be made of Delrin material, for example.

Figure 5:
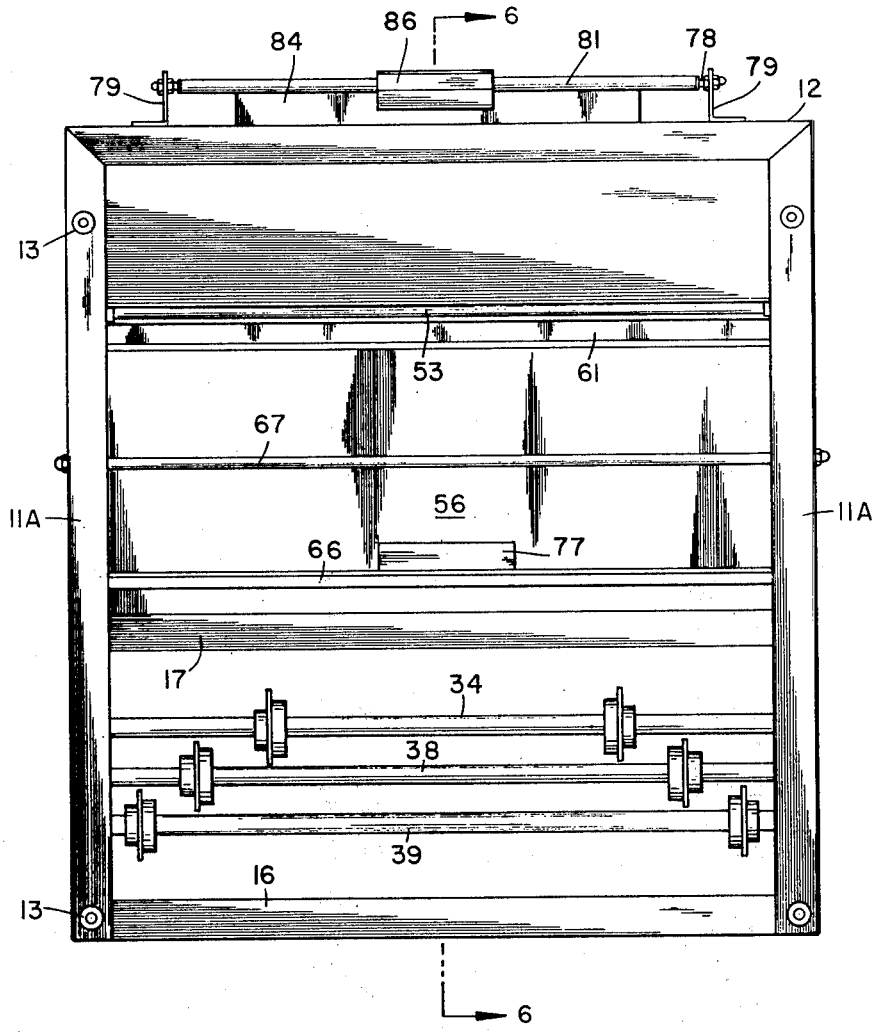
FIG. 5 is a bottom view thereof.
Figure 6A:
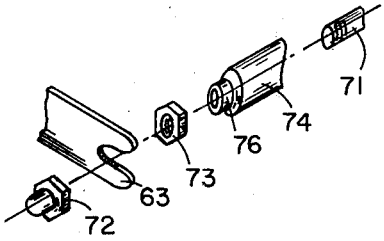
FIG. 6A is an exploded perspective view of a portion of a film guide clevis.

The upper end of each of the arms is notched and receives a roller mounting shaft 71 therein. This shaft is threaded at its opposite ends, and a combination of an accorn nut 72 and jamb nut 73 is used to tighten the shaft in the slot in the end of the arm. A hollow roller 74 having a suitable bushing 76 tightly received in each of its opposite ends encircles the shaft 71, with the bushing 76 providing lowfirction bearing support for the roller 74 on the shaft 71. An exploded view of these details is provided in FIG. 6A. A counterweight 77 is mounted to the lower cross arm 66 of the clevis such that the clevis is very slightly over balanced to normally rest in the position shown, with the lower cross arm 66 resting on the inturned flanges 11A (FIG. 5) of the side members 11.

A work support table 77 is mounted to table pivot shaft 78 (FIGS. 5 and 6) in essentially the same way as the film control roller 74 is mounted to shaft 71. The shaft 78 is mounted to brackets 79 affixed to the front cross member 12 by means of an acorn nut and jamb nut threadedly received on the shaft at each end, with the shaft being received in apertures in the brackets 79. Tube 81, having bushings in the ends thereof as does the roller tube 74, is pivotally mounted on shaft 78. The table 77 has a table portion 82 affixed to this tube and extending upwardly therefrom to the upper margin 83 and downwardly therefrom to the rearwardly projecting shelf 84 which engages the upper edge of the front crossmember 12 when the table portion 82 is vertical as shown in FIGS. 1 through 7, and prevents it from tilting backward. At such time, shelf 84 extends rearwardly, flush with the top of the platen 47. A pivot stop arm 86 projects down from the shelf 84 and forwardly so that, as the table is tilted forwardly in the direction of arrow 87 (FIG. 6) the stop 86 will engage the front cross member 12 and stop the tilting when the table has reached the position shown by the dotted outline 82F in FIG. 6. The table has finger notches 88 in the side edges 89 thereof, as shown best in FIGS. 2 and 7.

The clevis roller 74 has already been mentioned. There are three additional rollers similar to the clevis roller. These are the upper, intermediate, and lower film rollers 91, 92 and 93 respectively. Upper roller 91 has a pair of bushings 96 (FIG. 2) in the opposite ends thereof and rotatably received on a shaft 97 which is received in apertures in the columns 19 and retained in place by a pair of collars 98 snugly received on the shaft. The bushings 96 may typically be made of "Delrin" material, and serve as radial and end thrust bearings for the roller 91. Accordingly, this roller is freely rotatable on the shaft 97. The same arrangement is provided for rollers 92 and 93.

Operation

In the use of the apparatus, three rolls of plastic film may be mounted to the hubs on the three shafts. An example is shown in FIG. 6 where roll 42 is mounted to the upper shaft, roll 101 is mounted to the intermediate shaft and roll 102 is mounted to the lower shaft. The lead end of the film is passed from upper roll 42 behind and under the upper roller 91 and over the upper front spacer rod 22 and hangs to the point 103, as shown in FIG. 6. The lead end 104 of the intermediate roll passes down and under the intermediate roller 92 and over the spacer rod 23. The lead end portion 106 of the lower roll 102 rests on top of the material support table 56, being under the lower roller 93.

Figure 8:
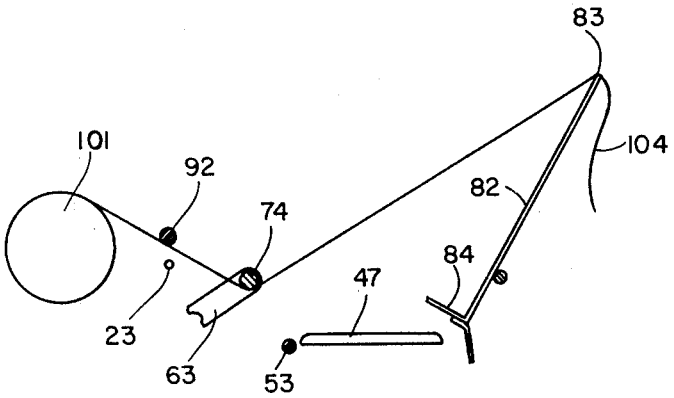
FIGS. 8 through 15 are schematic diagrams illustrating various steps in the procedure according to a typical embodiment of the method of the present invention.
Figure 10:
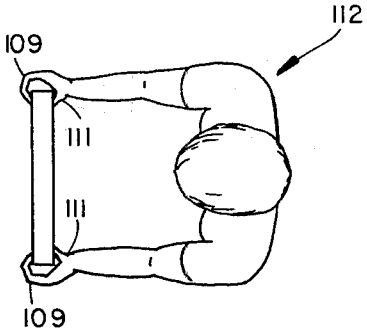
Figure 9:
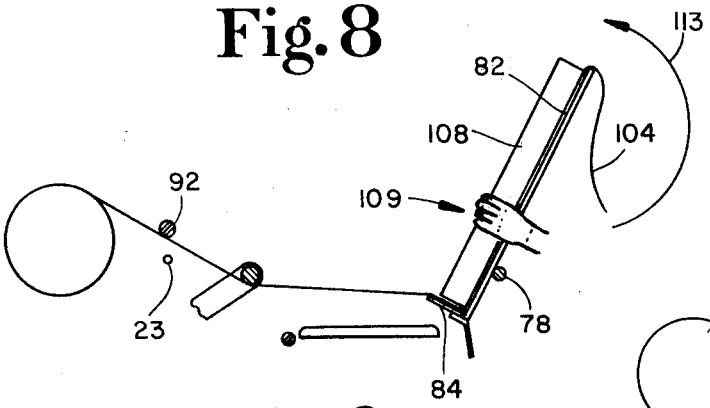

Assuming that the material to be used is on the intermediate roll 101, the lead end 104 is pulled forward under the clevis roller 74 and up over the top edge 83 of the support table, with that table tilted forward in the starting position which is shown in the dotted line 82F in FIG. 6 and in the solid line 82 in FIG. 8. A stack of material, which will be identified as a stack of paper sheets 108 for this example, is gripped between the fingers 109 and thumbs 111 of the operator 112, lifted over the top edge 83 and placed against the table back 82 as shown in FIG. 9. In so doing, the film is sandwiched between the front of the stack and the back 82 of the table. The finger holes 88 in the sides of the table back facilitate the handling of the material to place it securely against the table back, even if the stack (pack) is comparatively narrow. The lower edge of the stack is rested against the shelf 84 of the table.

Figure 13:
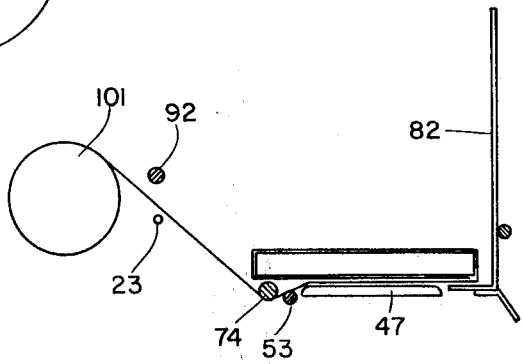
Figure 11:
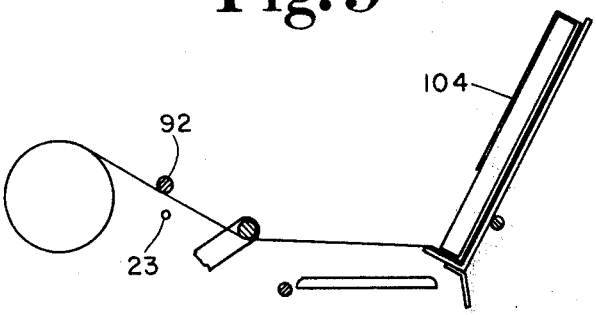
Figure 12:
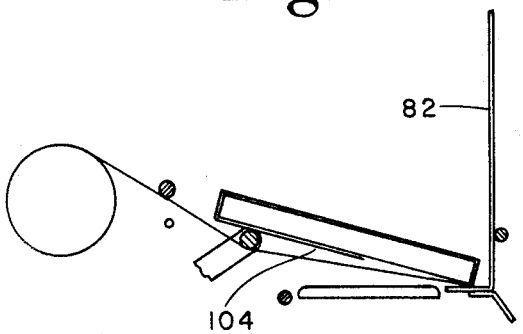

With the pack resting in the support table, both hands may be used to lift the lead end of the film back over the top edge of the table back as indicated by arrow 113 and place it down over the back of the pack as shown in FIG. 11. Then with both hands holding this lead edge against the back of the pack, the pack itself is tilted rearward about the table pivot axis of the shaft 78 until the pack is down on the heat table top as shown in FIG. 12. As this occurs, the support table returns to the upright position of FIGS. 1 through 7. Also, as the pack is tilted down onto the heat table, the upper portion of the pack engages the clevis roller as shown in FIG. 12 and pushes it down from the position shown in FIGS. 1 through 11, to the position shown in FIG. 13 where the roller is nested in the space 114 between the downturned portion 58 of the material support table and the heated cut-off bar 53. As it does so, it drags the film down and, upon contact of the film with the cut-off bar, the film melts and separates. Meanwhile the lead end 104 of the film on the rear (not bottom) of the paper stack is heat sealed to the other film under the stack, and shrunk tight on the stack, by the heat table.

Figure 14:
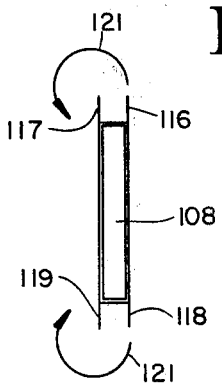
Figure 15:
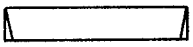

Following the heat sealing and cut-off, the operator raises the pack off the heat table, whereupon the film has marginal portions as at 116 and 117 at the front and rear of the package, respectively at the right-hand side, and similar portions 118 and 119 at the left-hand side. These are folded around by hand as shown by the arrows 121 in FIG. 14 so that they are on the back of the package. With some plastics, the marginal portions will automatically stick to the back, and nothing further need be done. With other plastic films, it may be desirable to again lower the package onto the heat table to heat seal these marginal portions to the back of the package. The package is thereby completed as shown in FIG. 15. The lead end of the film immediately behind the line of cut-off, will be resting on the material support table 56 adjacent the recess 114, ready to be picked up and pulled forward over the upper edge 83 of the support table to commence wrapping another stack of paper.

The present invention provides a comparatively inexpensive apparatus to facilitate the wrapping of stacks of sheet, card or plate form materials by operators having very little training or skill. It can accommodate a variety of types and sizes of materials to be wrapped, and wrapping materials. An example of suitable wrapping material is polyethylene or polyvinylchloride film of a thickness of one inch or less.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

The invention claimed is:

1. A wrapping apparatus comprising:

a longitudinally extending base having front and rear ends;

a heat table on said base between said ends having a heated top suface for heat sealing a wrapped package;

a work support table mounted to said base ahead of said heat table and having a generally upstanding back portion with a rearwardly projecting support shelf adjacent said heat table, for receiving on said back portion and shelf a strip of wrapping material, and for receiving on the strip, the product to be wrapped, and supporting both the product and wrapping material strip and locating the product relative to the strip and commencing the wrapping of material on the shelf and back supported portions of the product; a severing means on said base behind said heat table; and a wrapping-material guidemember which is elongate and extends transverse to the base and is located above and behind said severing means and over the path of wrapping material from a supply to said work support table, and movably mounted to said base to move downward toward said severing means when the work and the wrapping material are rotated to partially wrap the work and engage the guide member with the partially wrapped package thereby urging the guide-member to move a trailing portion of wrapping material downward to the severing means for severing.

2. The apparatus of claim 1 and said severing means comprising:

an elongate hot strip means on said base parallel to said guidemember and immediately ahead of the path of downward movement of said member, for heat severing wrapping material along a line transverse to the base as the wrapping material is moved downward behind the heat table by said guidemember.

3. The apparatus of claim 2 wherein said guide member is mounted to said base to move in an arcuate path about a first pivot axis parallel to said guide member;

said hot strip means is a heated rod immediately behind said heat table; and the mounting of said guide member establishes said arcuate path passing immediately behind said heated rod.

4. The apparatus of claim 3 and further comprising:

wrapping-material supply means behind said guide member and including shaft means mounted to said base and extending parallel to said guide member.

5. The apparatus of claim 3 wherein:

said work support table is pivotally mounted to said base to pivot on a second pivot axis parallel to said first pivot axis.

6. The apparatus of claim 5 wherein:

said work support table is pivotal from a forwardly inclined position, rearwardly about said second pivotal axis to an upright position wherein said shelf thereof is substantially parallel and co-planar with the top of said heat table.

7. The apparatus of claim 3 and further comprising:

guide member mounting means including a pair of side arms, each pivotally mounted to said base at said first pivot axis, and a lower bight portion, transverse to said base and connected to said arms at a level below said first pivot axis, said side arms and bight portion forming a clevis;

said guide member being mounted to said side arms above said first pivot axis.

8. The apparatus of claim 7 wherein:

said bight portion is behind of said first pivot axis, and said guide member is ahead of said first pivot axis, with said side arms extending upwardly and forwardly from said bight portion through said first pivot axis to said guide member.

9. The apparatus of claim 7 and further comprising:

a wrapping material support table extending rearwardly behind said hot strip means and below said guidemember;

said clevis and guidemember are balanced to normally maintain said guidemember spaced above said wrapping material support table, but accommodate downward movement of said guidemember in said arcuate path under the weight of an item of work to be wrapped.

10. The apparatus of claim 9 wherein:

said guide member is a roller, rotatably mounted to shaft means affixed in yokes at upper ends of said arms.

11. The apparatus of claim 9 wherein:

a transverse, upwardly opening recess is provided between said heat table and said wrapping material support table to receive said guidemember therein when moved downward by the weight of an item of work to be wrapped as the item is lowered from the work support table onto the heat table.

12. The apparatus of claim 11 wherein:

said heated rod is at the front of said recess and said guide member is receivable behind it in said recess.

13. The apparatus of claim 6 wherein:

said base has a front crossmember at said front end; and said shelf is engageable with an upper edge of said front crossmember upon rearward pivoting of said work support table to limit said pivoting to place said shelf in said substantially co-planar position.

14. The apparatus of claim 13 wherein:

a pivot stop is coupled to said work support table and engageable with said front crossmember to limit the amount of forwad incline of said work support table.

15. A method of wrapping an item of work comprising the steps of:

pulling a strip of wrapping material forward from a supply source and over the back of a forwardly inclined support table and down in front of at least a portion of said table so that a leader portion of said strip hangs down in front of said table;

placing a work item on top of the strip on top of the back of the table, while said leader portion continues to hang in front of said table and a trailing portion of the strip extends backward under a lower edge of the work item and back to the supply source;

lifting the leader portion and turning it back and downward over the top and part of the back of the work item;

holding the leader portion against the back of the work item and tipping the work item backward and downward onto a heat table and thereupon heat sealing the leader portion to a frontal part of said trailing portion of said strip under said back to complete a 360° wrap of the work item, and engaging a strip guidemember with the work item during the tipping step, and using the work item for depressing the guidemember and thereby depressing a part of the trailing portion which is behind the heat table onto severing means for severing the trailing portion behind the heat table.

16. The method of claim 15 and further comprising the steps of:

shrinking the strip onto the item during the heat sealing step.

17. The method of claim 15 wherein said part of the trailing portion is depressed to a level below said heat table.

18. The method of claim 15 wherein said engaging and depressing steps are by contact with said work item as sides of the item are gripped by left and right hands of an operating person.

19. The method of claim 15 wherein:

the guidemember depressing step depresses part of said trailing portion onto a heat severing member to cut off the trailing portion behind said heat table.

20. The method of claim 19 and further comprising the steps of:

picking up the 360° wrapped item, turning side marginal portions of the wrapping strip around the sides of the item and sealing them against the wrapped material at the back of the item.

21. The method of claim 20 wherein:

said sealing of marginal portions is by placing the item down on the heat table again with the marginal portions against the wrapped material at the back and against the heat table.

22. The method of claim 15 and further comprising the steps of:

pivoting the support table upward during the upward portion of said tipping step, and stopping upward movement of the table while the work item is tipped backward and downward.

23. The method of claim 22 wherein:

the strip pulling step is from a selected one of a plurality of wrapping film rolls in vertically stacked spaced relationship behind the heat table.

* * * * *